United States Patent [19]

Lerner

[11] 3,938,299

[45] Feb. 17, 1976

[54] PACKAGING SYSTEM AND METHOD

[75] Inventor: Bernard Lerner, Hudson, Ohio

[73] Assignee: Automated Packaging Systems, Inc., Twinsburg, Ohio

[22] Filed: May 7, 1974

[21] Appl. No.: 467,791

Related U.S. Application Data

[63] Continuation-in-part of Ser. No. 336,560, Feb. 28, 1973, which is a continuation-in-part of Ser. No. 139,453, May 3, 1971, Pat. No. 3,815,318.

[52] U.S. Cl. ..... 53/22 B; 53/29; 53/37; 53/112 B; 53/187; 53/385

[51] Int. Cl.[2]... B65B 31/00; B65B 5/00; B65B 7/06

[58] Field of Search ..... 53/22 A, 22 B, 24, 29, 53/37, 39, 40, 385, 112 A, 112 B, 187, 373, 389, 124 A:124 B, 124 C

[56] References Cited

UNITED STATES PATENTS

| | | | |
|---|---|---|---|
| 2,633,684 | 4/1953 | Rohdin | 53/112 A |
| 2,852,898 | 9/1958 | Berg | 53/373 X |
| 2,919,990 | 1/1960 | Podlesak et al. | 53/112 A |
| 3,010,265 | 11/1961 | McClosky | 53/112 A |
| 3,070,931 | 1/1963 | Zwight | 53/187 X |
| 3,075,325 | 1/1963 | Liedtke | 53/389 X |
| 3,448,555 | 6/1969 | Shabram | 53/29 |
| 3,477,196 | 11/1969 | Lerner | 53/22 B |
| 3,481,102 | 12/1969 | Dolman | 53/29 |
| 3,492,775 | 2/1970 | Rhine et al. | 53/29 |
| 3,699,746 | 10/1972 | Titchenal et al. | 53/187 |

*Primary Examiner*—Travis S. McGehee
*Assistant Examiner*—Horace M. Culver
*Attorney, Agent, or Firm*—Watts, Hoffmann, Fisher & Heinke Co.

[57] ABSTRACT

A packaging system utilizes a resilient pressure roll to compress a flexible wall of open, loaded container portions of a packaging web as the container portions are moved with the web from one work station to another. The pressure roll participates in feeding the web while expelling air from the loaded container portions to closely conform the container portions to articles therein and isolating portions of the web at the first work station from forces applied to the web at the second work station. Typically, the container portions are loaded at the first work station and closed, sealed, and severed from the remainder of the web at the second work station.

11 Claims, 5 Drawing Figures

PACKAGING SYSTEM AND METHOD

CROSS REFERENCE TO RELATED PATENTS AND APPLICATIONS

The present application is a continuation-in-part of an application entitled PACKAGING METHOD AND APPARATUS, Ser. No. 336,560, filed Feb. 28, 1973 as a continuation-in-part of application Ser. No. 139,453, filed May 3, 1971, and now U.S. Pat. No. 3,815,318, entitled PACKAGING METHOD AND APPARATUS, here the "Machine Patents" the disclosures of which are incorporated by reference.

FLEXIBLE CONTAINER STRIPS, U.S. Pat. No. 3,254,828 issued June 7, 1966, to Hershey Lerner, here the "Article Patent."

PACKAGING APPARATUS AND METHOD, Ser. No. 374,902, filed June 29, 1972 by H. Hampton Loughry, and now U.S. Pat. No. 3,861,113, here the "Deflation Patent."

BACKGROUND OF THE INVENTION

1. Field of the Invention

The present invention relates to packaging and more particularly to a packaging system and method wherein articles are packaged in successive container portions of packaging webs with the container portions closely conformed to the articles and wherein individual packages are separated from the web without any adverse effects on portions of the web being loaded.

2. Prior Art

The Article Patent describes a packaging web or container strip formed by a chain of interconnected container detachable bag-like portions. The container portions each define a load opening in one face and a transverse seal line defining a closed end of each container portion. The other face of each container is connected to a contiguous container portion along a preformed line of weakness so that the container portions are relatively easily detached from the web.

The Machine Patents disclose packaging apparatuses for feeding such a web or strip of container portions to a loading station at which successive container portions are opened, loaded, closed, sealed and severed from the web. The closure is effected by a pair of relatively movable closure members which engage the open end region of the container portion, to clamp the faces of the container portion together. The closure is then secured, typically by heat sealing the faces together.

In some packaging applications, it is desirable to confine a quantity of air in the sealed containers to prevent the contents from being crushed or damaged during shipment. In other packaging applications, it is desirable to deflate the containers before they are sealed to minimize the volume of the sealed containers. While the apparatus of the Machine Patents are well adapted to confine a quantity of air in containers as they are closed and sealed, such apparatuses do not address the problem of deflating containers prior to closure.

The Deflation Patent describes a resilient pressure pad including a plurality of resilient elements which are individually compressible against a loaded container portion to conform the container portion to the shape of its contents and in so doing expel air from the container portion prior to its closure.

Where relatively long articles are packaged, the use of such a pressure pad to deflate a loaded container portion requires that the pressure pad be quite lengthy. Moreover, where the container portions are relatively long and narrow, a lengthy pressure pad brought into engagement with the full side area of the container portion may tend to close its open end before the expulsion of air from regions near the closed end of the container portion.

Furthermore, when apparatus of the character described in the Machine Patents is used to package articles such as flexible sheet paper material, fabrics, and so forth which must be hand-loaded, the packaging process can be cumbersome and time consuming. Since the apparatus utilizes a single station for loading, closing and sealing, the operator must wait until one sealing operation is completed before a subsequent container portion is positionable for loading. Loading the subsequent container portion must be accomplished by stuffing the article into the container portion between the closure members. Even though the closure members are separated, their presence adjacent the load opening tends to impede the loading procedure. The container portion being loaded is usually unsupported and this, along with the obstruction created by the closure members substantially slows the loading process. If the subsequent container portion is to be deflated, this step must occur between the loading and sealing steps. Thus, the difficulties in hand loading along with the deflation operation increases the cycle time of the apparatus appreciably.

A problem which is frequently encountered in packaging applications is the need to isolate web portions in one location or work station from forces which are applied to web portions in a nearby location or work station. For example, where a loaded container portion is severed from the end of a web by exerting forces on the loaded container portion for tearing from the web along the line of weakness between the container portion and the web, the tearing force can be transmitted along the web to other lines of weakness remote from the loaded container portions. If adequate precautions are not taken to prevent transmission of such forces along the web, two or more container portions will be severed from the web simultaneously.

SUMMARY OF THE INVENTION

The present invention provides an improved packaging system and method wherein hand loading of container portions is greatly facilitated and can be accomplished while a previously loaded container portion is being severed and/or sealed closed, wherein the loaded container portions are closely conformed to the articles contained in them without increasing the cycle time of the apparatus and in which forces applied to the loaded container portions during severing are not transmitted along the web to remote lines of web weakness.

In accordance with the principles of the present invention, a packaging web or container strip, formed by a plurality of container portions, each defined at least by a load opening and a line of weakness along which the container portion is severable from the web, is fed to a loading station and then to a work station at which the loaded container portions are closed and/or severed from the web. The web is supported at the loading station so that articles are relatively easily hand loaded into one or more container portions which are disposed at the loading station. Loaded container portions are closed and/or severed at the work station while hand loading takes place at the loading station.

A web engaging unit is disposed between the loading stations and the work station which functions to participate in feeding the web from the loading station to the work station, closely conform the loaded container portions to their contents by expelling air from each successive loaded container portion as it moves to the work station and to isolate the web portion at the loading station from forces applied to a loaded container portion at the work station.

In one preferred embodiment of the invention, a loading station is defined above a work station at which loaded container portions are sealed, closed and severed from a web. A web of interconnected bag-like container portions descends along an inclined, generally vertical path provided by the loading station and to the work station. The container portions are fed closed-end first so that the load opening of each container portion is oriented upwardly for easy loading. A pair of rolls, at least one of which is a soft, resiliently deformable pressure roll, is provided between the loading and work stations and loaded container portions are fed by and between the rolls to the work station. As each loaded container portion passes between the rolls, the resiliently deformable roll urges the container portion into close conformity with its contents and expels air from the container portion through its load opening. The deformable roll also grips the web when a loaded container portion has been properly fed to the work station to effectively isolate web portions at the loading station from such forces as may be applied to web portions which have been fed beyond the deformable roll.

The work station of the preferred embodiment includes a gripper bar assembly, sealing bar and heater bar which are movably mounted to sever a gripped and sealed container portion from the remainder of the web as described in the referenced Machine Patents.

A general object of the present invention is the provision of a novel and improved packaging system and method utilizing a resilient pressure roll for compressively engaging loaded flexible wall containers without damaging their contents.

Other objects and a fuller understanding of the invention may be had by referring to the following description and claims taken in conjunction with the accompanying drawings.

DETAILED DESCRIPTION OF A PREFERRED EMBODIMENT

Figure 1:
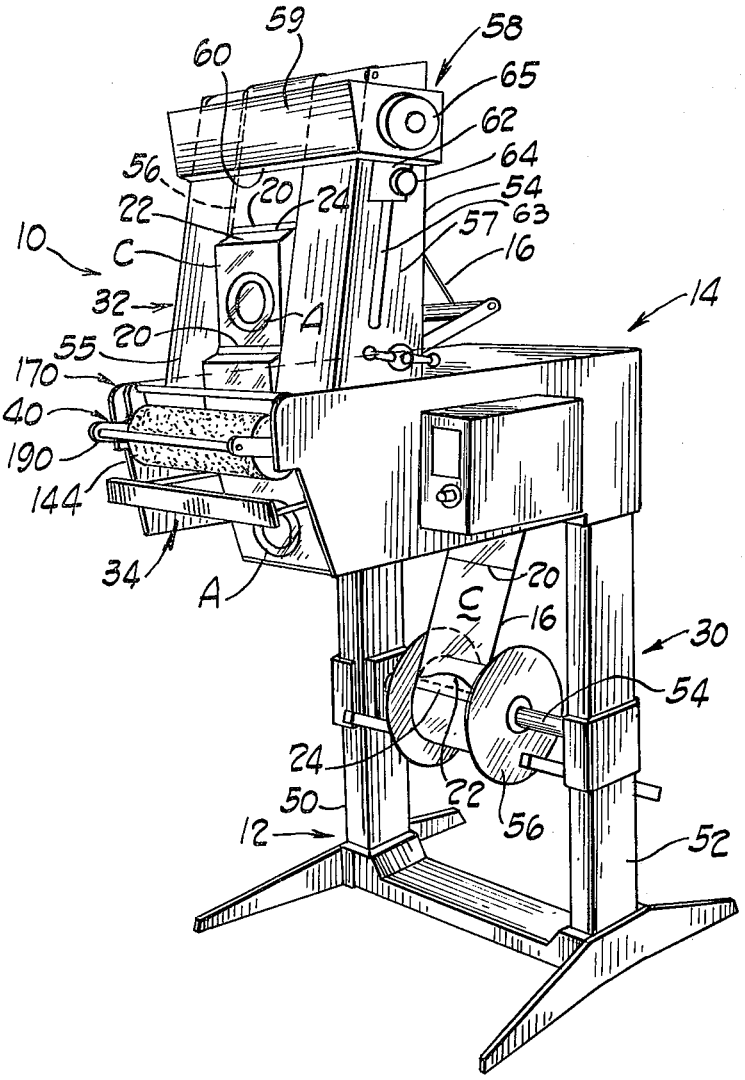
FIG. 1 is a perspective view of a packaging apparatus constructed in accordance with the present invention.

A packaging system 10 constructed in accordance with the preferred embodiment of the present invention is illustrated in FIG. 1. The system 10 comprises a base frame 12 which supports a packaging machine body 14 and provides for packaging articles A in a packaging web, or container strip, indicated at 16.

In the illustrated embodiment of the invention, the web or strip 16 is a film-like heat-sealable plastic material, such as polyethylene, which is constructed as disclosed by the above-referenced U.S. Article patent, U.S. Pat. No. 3,254,828. The web or strip 16 therefore is defined by a series of container portions C, each of which is defined by a transverse heat seal 20 forming a closed end of the container portion, a load opening 22 remote from the heat seal 20, a transverse line of weakness 24, which in the illustrated web is a line of perforations coextending with the load opening 22 to permit the container portion C to be severed from the web or strip 16.

The packaging system 10 includes a web supply, generally indicated at 30, a loading station 32, and in the illustrated embodiment of the invention, a work station 34 at which loaded container portions C are closed, sealed closed, and severed from the web 16 to form a completed package for the articles A. The web 16 is fed from the web supply 30 through the machine body 14 by a web feeding mechanism which advances the web intermittently along a path of travel from the web supply 30 through the loading station 32 and to the work station 34. A web engaging unit 40 is disposed between the loading station 32 and the work station 34 on the path of web travel for cooperating with the feeding mechanism in advancing the web through the loading station, closely conforming loaded container portions to articles therein by expelling air from the loaded container portions as they are fed to the work station 34, and isolating the portions of the web 16 at the loading station 32 from forces applied to loaded container portions C at the work station 34.

In the preferred embodiment of the invention the web supply 30 is supported between upstanding support frame legs 50, 52 and is defined by a mandrel 54 removably supported between the legs 50, 52 and the web roll 56 which is rotatable on the mandrel with respect to the legs to enable the web or strip 16 to be let off from the roll by the web feeding mechanism. The web supply 30 can be of any conventional or suitable construction and therefore is not described in further detail.

Container portions of the web 16 are opened and supported for loading at the loading station 32. The illustrated loading station 32 is defined by an upstanding sheet metal support member 54 fixed atop the machine body 14 and defining a web supporting wall structure 55 extending upwardly from the body 14 at a slight incline towards the rear of the machine, and supporting side walls 56, 57 which are disposed at right angles to the wall 55, extend rearwardly along the machine body and terminate in vertically disposed stiffening lips.

Figure 2:
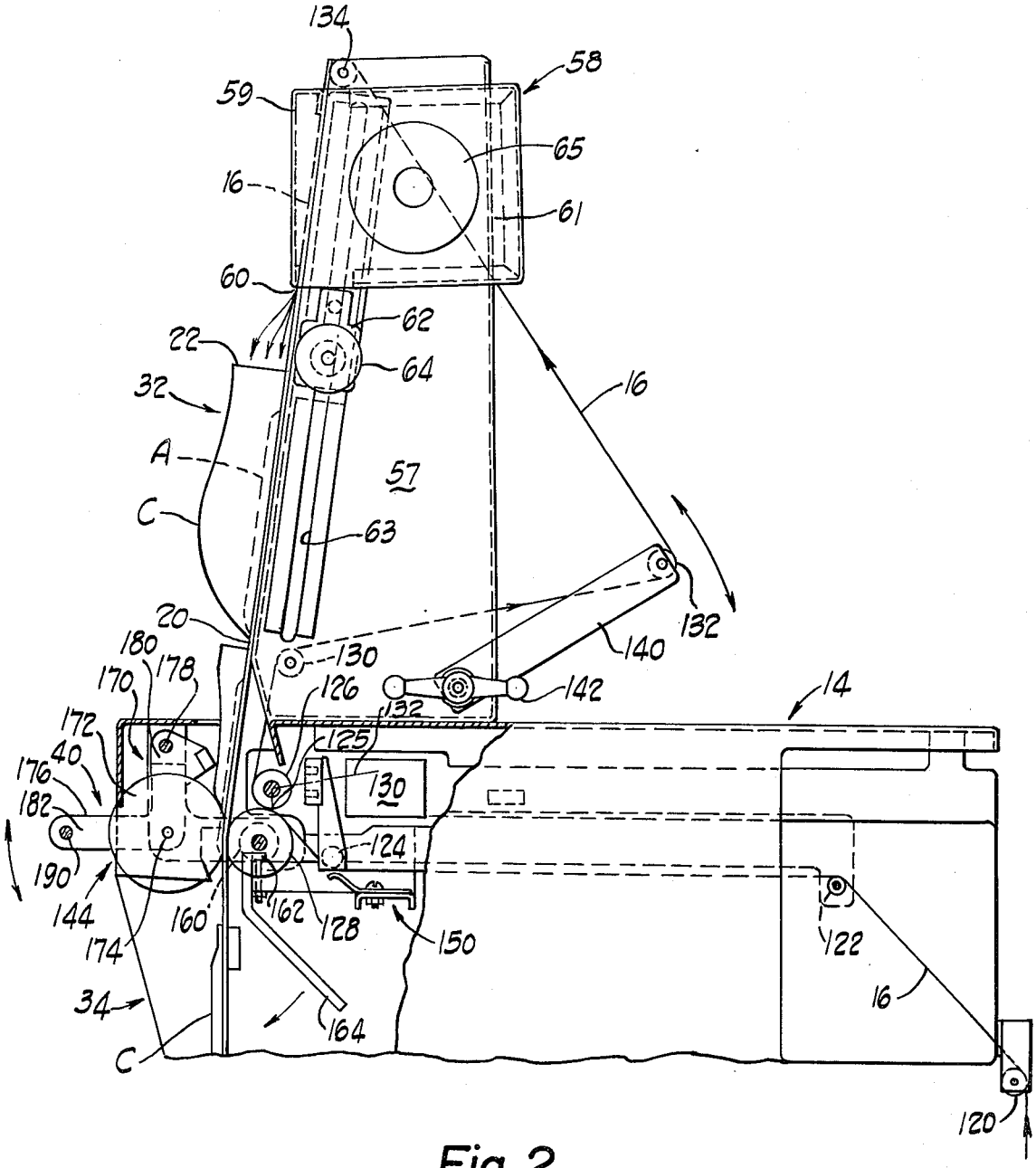
FIG. 2 is a side elevational view on an enlarged scale with portions broken away and shown in cross section.

The web 16 extends over the top of the wall 55 and downwardly along the front face of the wall where the web is supported so that the articles A can be hand loaded into successive ones of the container portions C as illustrated in FIGS. 1 and 2.

A container opening unit 58, by which successive container portions C at the loading station are opened for loading, is supported on the member 54. The unit 58 produces a stream of air which flows downwardly along the wall 55 to blow open and partially inflate each successive container portion C for loading. In the illustrated and preferred embodiment of the invention, the unit 58 comprises a generally U-shaped tubular sheet metal manifold 59 defining an air directing opening 60 in the form of a narrow, downwardly-oriented slot which extends across the full width of the wall 55. Opposite end portions 61 of the manifold 59 extend rearwardly along the exterior of the side walls 56, 57 and each manifold end portion is provided with a supporting clamp assembly 62 by which the manifold end portions 61 are supported in elongated side wall slots 63. Each clamp assembly 62 includes a knob 64 which, when loosened, enables the unit 58 to be slid to a desired location along the slots 63 to enable adjustment of the effective length of the loading station. The knob 64 is then tightened to secure the manifold in position. A blower unit 65 is supported in one manifold end portion to induce a flow of air into the manifold and through the air directing slot 60.

As is best seen in FIG. 2, the web 16 is fed between the wall 55 and the manifold 59 so that as each load opening of a container portion C passes downwardly beyond the air directing slot 60, that container portion is at least partially inflated to open the container portion for loading.

The manifold 59 is preferably positioned so that the length of the wall 55 extending below the opening 60 is at least equal to the length of one container portion C. This permits loading of such a container portion while it is stationary at the loading station and even while the container portion is moving downwardly along the wall 55.

Figure 3:
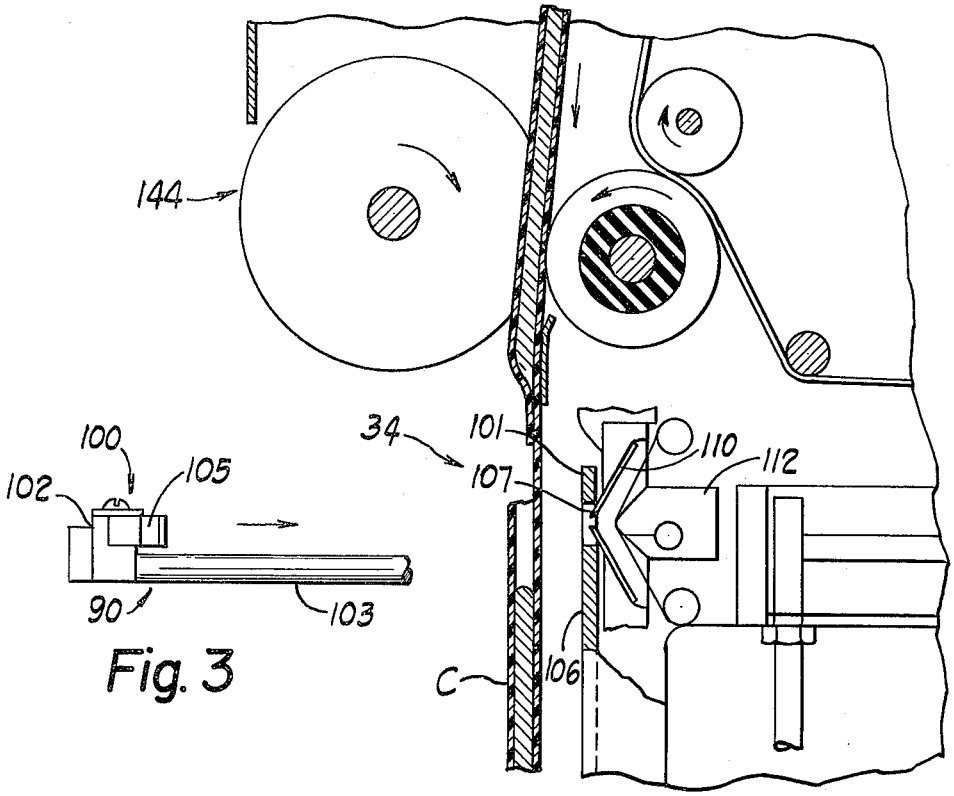
FIG. 3 is a fragmentary cross-sectional view of a portion of the packaging apparatus illustrated in FIG. 1 with parts removed and on a scale which is larger than the scale of FIG. 1.
Figure 4:
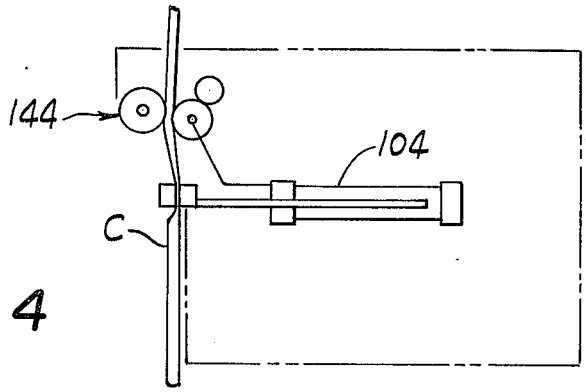
FIG. 4 is a schematic cross-sectional view of a portion of the apparatus illustrated in FIG. 1; and, FIG. 5 is a schematic elevational view seen approximately from the plane indicated by the line 5—5 of FIG. 4 with parts illustrated in a different operating position.
Figure 5:
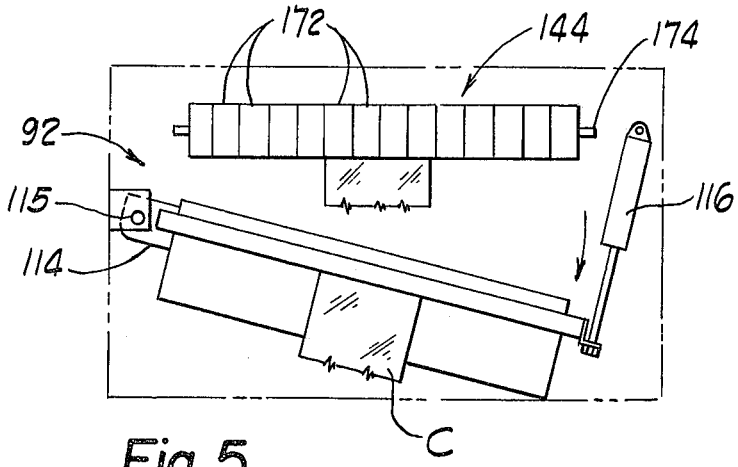

The work station 34, in the preferred and illustrated embodiment of the invention, functions to close and seal a loaded container portion at the station 34, while substantially at the same time severing the container portion from the web to provide a completed package. As is best seen in FIGS. 3–5 the station 34 is defined by a closure and sealing assembly generally indicated by the reference character 90, and a severing mechanism 92 (FIG. 5).

The closure and sealing assembly 90 includes a pair of relatively movable closure units 100, 101 which close, grip and seal a loaded container portion C which is registered with the station 34. The closure unit 100 includes a closure bar 102 supported on rods 103 for movement toward and away from the closure unit 101 by an actuator 104. As described in detail in the Machine Patents, the closure bar 102 carries a resilient pad assembly 105 for engaging the open region of the container portion C and effecting its closure by clamping the end region against the closure unit 101.

The unit 101 includes a guard bracket 106 defining a slot 107 extending in a direction transverse to the container portion C. A gripper assembly 110 and a heater bar 112 are positioned inwardly of the slot 107. During the final inward clamping movement of the closure bar 102, a portion of the now closed end region of the container portion C is pressed through the slot 107 and into engagement with the gripper assembly 110 and the heater bar 112 to heat seal the container portion closed.

The closure and sealing assembly 90 is supported by the severing mechanism 92 for pivotal movement downwardly away from the loading station 32 to sever a gripped loaded container portion from the remainder of the packaging web 16. As illustrated in FIG. 5, the mechanism 92 comprises a member 114 which supports the assembly 90 and is connected to the machine body 14 at one end by a hinge 115 and at its other end by an actuator 116. The actuator 116 is retracted when the assembly 90 operates to clamp the container portion C, and when the container portion is clamped by the assembly 90, the actuator 116 is extended to pivot the support member 114 about the hinge 115 and thus apply a severing force to the line of weakness between the clamped container portion C and the remainder of the web. A container portion C is shown gripped between the closure units 100, 101 in FIG. 4, and in FIG. 5 the pivotal movement of these units is illustrated as having effected the severance of the container portion C. After severance the now closed and sealed package is dropped from the assembly 90 when the actuator 104 returns the units 100, 101 to their initial position, and the actuator 116 is retracted to return the assembly 90 to its initial position.

The web engaging unit 40 isolates the web portions at the loading station 32 from the severing forces applied by the mechanism 92. The structure and operation of the assembly 90 and the mechanism 92 are described in greater detail in the Machine Patents to which reference should be made if further detailed information is desired.

Referring again to FIG. 2, the web path of travel from the web supply 30 through the work station 34 is defined by the web feeding mechanism. The web 16 enters the machine body 14 from the web supply 30 and trained over web guiding idler rollers 120, 122, 124 all of which are supported for free rotation in the body 14. The web 16 passes from the roller 124 through a nip 125 defined by feed rolls 126, 128. In the illustrated embodiment of the invention the roll 126 is driven from an electric drive motor 130 via a suitable transmission, schematically shown at 132. The roll 126 is in driving engagement with the roll 128 via the web 16 between them so that the rollers 126, 128 rotate together substantially without slipping as they pull the web 16 from the web supply 30. The roll 128 may be provided with a soft resiliently deformable peripheral portion if desired or may be provided with a relatively rigid rubber-like periphery, depending on intended usage of the system 10.

The web 16 extends from the roll 126, 128 over a guide idler roller 130 which is rotatably supported between the side walls 56, 57, a position adjustable guide idler roller 132 and a final guide idler roller 134 which is rotatably supported at the upper end of the loading station wall 55 for directing the web 16 downwardly through the loading station 32.

The web 16 is fed from the rolls 126, 128 to the work station 34 by the web engaging unit 40 in cooperation with the feed roll 128. As is best illustrated in FIGS. 2 and 3, the unit 40 includes a soft resiliently deformable roll member 144 which is biased towards engagement with the roll 128 so that loaded container portions C are engaged between the rolls 128, 144 at a location between the stations 32, 34. When the motor 130 operates the roll 128 is rotated in the manner described above and, with the cooperating roll 144, advances loaded container portions C to the work station 34 from the loading station 32.

The feed rolls 126, 128 are intermittently driven by their motor 130 so that successive loaded container portions C are accurately located at the work station 34 for sealing and severing in the manner described above. Webs having container portions C of various lengths are usable in the system 10 and to appropriately position container portions at the web station 34, the length of the web path of travel between the work station 34 and the rolls 126, 128 must be adjustable. The roller 132 is adjustably positionable to alter the length of the web path of travel. As is best seen in FIG. 2 the roller 132 is supported at its opposite ends by arms 140 which in turn are rotatably supported by the respective adjacent loading station side walls 56, 57. The arms 140 are preferably supported by a manually operated clamp 142 so that the arms may be swung about their supports in the walls 56, 57 to alter the position of the roller 132 as desired to adjust the web path length.

Once the length of the web path of travel from the rolls 126, 128 to the work station 34 is appropriately adjusted, intermittent feeding of the web 16 is governed by a web position sensing unit 150 which terminates operation of the roll drive motor 130 in response to the sensed presence of a predetermined web location at the unit 150. The unit 150 may be of any suitable construction but in the preferred and illustrated embodiment of the invention is a spark detecting device which is effective to sense the presence of a web line of weakness at the roller 124 and terminate operation of the motor 130 in response to such detection.

The roll 128 is rotatably supported by bearing elements 160, only one of which is illustrated in FIG. 2, which are in turn supported for rotation about a cam element 162 by movement of a lever 164. The lever 164 is manually moved clockwise, as seen in FIG. 2, to shift the roll 128 away from the roll 126 to enable initial threading of the web 16 between the rolls 126, 128.

In addition to cooperating in feeding of the web 16 from the loading station 32 to the work station 34, the web engaging unit 40, and particularly the roll 144, function to closly conform the loaded container portions C to their contents by expelling air from the container portions as such container portions are fed to the work station 34 and, further, isolates the portion of the web at the loading station 32 from severing forces applied to the container portions at the work station 34.

In the preferred and illustrated embodiment of the invention the web engaging unit 40 includes the roll 144 and a roll supporting mechanism 170 for positioning the roll 144 and biasing the roll 144 towards the roll 128.

The roll 144 is formed by a plurality of annular soft foam rubber elements 172 (see FIG. 5) supported in side-by-side relationship on a central shaft 174. The elements 172 are freely rotatable on the shaft 174 and are individually deformable as a loaded container portion passes the roll 144 so that the expulsion of maximum air from the container portion by the roll 144 is assured. Container portions C passing to the work station 34 are thus closely conformed to their contents.

The roll supporting mechanism 170 comprises a pair of roll supporting levers 176 disposed at respective opposite ends of the roll 144 and which are fixed to an articulating rod 178 extending between opposite side walls of the machine body 14 parallel to and vertically elevated from the axis of the roll 144.

The levers 176 are generally L-shaped with upwardly extending arms 180 fixed to the articulating rod and outwardly projecting arms 182 extending forwardly from the machine 14. The roll shaft 174 is fixed to the levers 176 at the junctures of the arms 180, 182 so that the roll 144 can be swung by the levers 176 about the axis of the articulating rod 178 away from the roll 128.

The projecting arms 182 are connected together by a handle bar 190 which enables the levers 176 and roll 144 to be manually swung away from the roll 128 to enable the web 16 to be initially disposed between the rolls 144, 128. The combined weight of the projecting arms 182 and the handle bar 190 exert a counterclockwise torque on the levers 176, as viewed in FIG. 2, which biases the roll 144 toward engagement with the feed roll 128. This biasing force is augmentable by springs if desired.

While a single embodiment of the invention is illustrated and described in considerable detail, the invention is not to be considered limited to the precise construction of the preferred embodiment. Various adaptations, modifications and uses of the invention may occur to those skilled in the art to which the invention pertains and the intention is to cover all such adaptations, modifications and uses which fall within the spirit and the scope of the appended claims.

What is claimed is:

1. A machine for packaging articles in container portions defined by a container strip comprising:

a. container strip storage means for a web-like container strip;

b. a work station at which loaded container portions of a container strip are successively subjected to a packaging operation;

c. container strip advancing means for advancing a container strip from said storage means to said work station; and, d. structure establishing a generally loop-like path of container strip travel extending upwardly from said advancing means so that the container strip is moved from said advancing means through said loop-like path returned to said advancing means and proceeds to said work station, said structure comprising a container strip loading station means including a support member providing a relatively rigidly supported portion of said loop-like path extending from said advancing means and along which articles are loaded into successive container portions of the container strip;

e. said advancing means including first and second cooperating container strip advancing roll members, said first roll member engaging the container strip for advancing the container strip from said storage means to said loop-like path of travel, said first and second roll members defining a nip through which the container strip is advanced from said loop-like path of travel to said work station when said first and second roll members rotate, one of said first and second roll members defining a peripheral surface portion resiliently engaging said container strip at said nip for compressively engaging the container strip with articles therein to flatten container portions advanced to said work station.

2. The apparatus claimed in claim 1 wherein said one roll member defines at least a resiliently deformable peripheral surface portion for compressively engaging loaded container portions during movement from said loading station to said work station.

3. The apparatus claimed in claim 2 wherein said surface portion of said one roll member is biased toward engagement with said other roll member.

4. The apparatus of claim 1 wherein said support member extends above said nip for supporting the container strip continuously along a length at least equal to the length of one of said container portions.

5. The apparatus of claim 1 wherein said work station is defined in part by severing means for severing a loaded container portion from the container strip, said first and second roll members cooperating to isolate container strip regions at said loading station from such forces as are produced by said severing means.

6. Apparatus as claimed in claim 1 wherein said structure for providing said loop-like path of travel further comprises a container strip engaging guide member and mechanism adjustably supporting said guide member for movement relative to said container strip advancing for changing the length of said loop-like path of travel.

7. A method of packaging articles in a web-like container strip defining a series of container portions comprising:

a. stationing a container strip at a supply station;

b. providing a loading station at which articles to be packaged are inserted into successive container portions;

c. establishing a work station at a location generally below the loading station and at which an operation is performed on successive loaded container portions;

d. stationing a container strip feeding means at a location generally above the level of the work station and below the level of the loading station with at least part of said strip feeding means interposed between said work and loading stations;

e. feeding the container strip from said supply station through said loading and work stations including:

i. advancing the container strip along a path of travel extending from said supply station to said feeding means;

ii. moving the container strip upwardly from said feeding means in a loop-like path of travel which extends past said loading station and proceeds downwardly toward said work station to said feeding means;

iii. advancing the container strip through said feeding means to said work station;

f. supporting the container strip at said loading station along a relatively rigid surface which extends along a a portion of said loop-like path of travel through a length at least equal to the length of the container portions of the container strip;

g. loading articles into container portions of the container strip supported at said loading station; and, h. closely conforming loaded container portions to articles therein to expel air from the container portions as each successive container portion passes through said feeding means proceeding toward said work station.

8. A method as claimed in claim 7 wherein closely conforming the container portions to articles therein includes resiliently engaging loaded container portions with a periphery of a feed roll member while advancing the container strip to the work station.

9. A method as claimed in claim 7 further including closing and sealing loaded container portions at said work station.

10. A method as claimed in claim 9 further including separating loaded container portions from the container strip at the work station and operating said feeding means to isolate the container strip along said loop-like path from separating forces applied at said work station.

11. A method as claimed in claim 7 further including adjusting the extent of said loop-like path to coordinate performance of operations at said work station with the length of the container portions and feeding of the container strip.

* * * * *